United States Patent [19]

Shiina et al.

[11] Patent Number: 5,052,676

[45] Date of Patent: Oct. 1, 1991

[54] SHEET FEEDING DEVICE

[75] Inventors: Toshihito Shiina, Yamanashi; Masahito Sano, Kofu; Shiyuzi Ishimaru, Yamanashi, all of Japan

[73] Assignee: Nisca Corporation, Yamanashi, Japan

[21] Appl. No.: 458,544

[22] Filed: Dec. 28, 1989

[30] Foreign Application Priority Data

| | | | |
|---|---|---|---|
| Dec. 28, 1988 | [JP] | Japan | 63-335181 |
| Dec. 28, 1988 | [JP] | Japan | 63-335182 |
| Dec. 28, 1988 | [JP] | Japan | 63-335183 |
| Dec. 28, 1988 | [JP] | Japan | 63-335184 |
| Dec. 28, 1988 | [JP] | Japan | 63-335185 |

[51] Int. Cl.[5] ..... B65H 3/32

[52] U.S. Cl. ..... 271/121; 271/167

[58] Field of Search ..... 271/121, 124, 167

[56] References Cited

FOREIGN PATENT DOCUMENTS

| | | | |
|---|---|---|---|
| 135040 | 10/1980 | Japan | 271/124 |
| 16951 | 1/1987 | Japan | 271/121 |
| 272728 | 11/1988 | Japan | 271/121 |

*Primary Examiner*—Richard A. Schacher

*Attorney, Agent, or Firm*—Oblon, Spivak, McClelland, Maier & Neustadt

[57] ABSTRACT

A sheet feeding device for feding stacked sheets one by one incorporates therein a sheet separator in which a friction pad touching a sheet feeding roller is rocked by one or more sheets passing through between the sheet feeding roller and friction pad, thereby to successfully separate the overlapping sheets. The rocking movement of the friction pad is fulfilled, for example, by providing the pad on its leading end within an uplift protrusion which is forced up by the sheet being contacted therewith. By the action of the friction pad thus rocked, the so-called double-feed phenomenon can be completely prevented.

10 Claims, 6 Drawing Sheets

SHEET FEEDING DEVICE

BACKGROUND OF THE INVENTION

1. Field of the Invention

This invention relates to a sheet feeding device for use in copying machines, various printers, facsimile transmitters and so on, and more particularly to an automatic sheet feeding device provided with a sheet separation means capable of completely preventing simultaneous feeding of overlapping sheets of paper or documents to reliably send out the sheets stacked on a sheet stacker one by one to a prescribed position in the copying machine or the like.

2. Description of the Prior Art

In image- or word-processing devices including printers of various types, copying machines, facsimile transmitters or the like in which copying or printing sheets of paper or sheet documents contained in a sheet stacker or cassette in a piled state are fed one by one to a prescribed position, a sheet sending-out stage is essentially provided with a sheet separation means for separating the overlapping sheets so as to allow only one sheet to pass therethrough. Thus, with the sheet separation means, simultaneous feeding of two or more overlapping sheets of paper, what is called "a double-feed phenomenon" can be prevented.

Conventionally there has been a sheet separation means of this type which comprises a sheet feeding roller and at least one friction member being in contact with the sheet feeding roller. The incorporated sheet feeding roller and friction member are generally disposed in close proximity to a sheet stacker in which a plurality of sheets of paper are contained in the piled state. When two sheets of paper are discharged from the sheet stacker and intrude into between the sheet feeding roller and friction member, one of the sheets which comes into contact with the friction member is prevented from advancing by the friction brought about by the friction member and the other sheet coming into contact with the sheet feeding roller is fed forward by the rotation of the roller. As a result, only one sheet is sent out toward the prescribed position.

Some of sheet separation means of the type that a friction pad or plate formed of rubber or other elastic material is used as the friction member noted above and comes into contact with a sheet feeding roller have been so far proposed in U.S. Pat. Nos. 4,368,880, 4,674,737 and 4,696,462, for instance.

Moreover, there have been sheet separation means of different types as disclosed in U.S. Pat. Nos. 4,085,929, 4,114,870 and 4,544,147. These conventional sheet separation means by and large employ a friction member which moves or rotates in the opposite direction to the rotation of a sheet feeding roller being in contact with the friction member in order to improve the sheet separating effect. In some of the prior art, this movable friction member is used jointly with the friction pad or plate touched upon above.

However, the conventional sheet separation means cannot necessarily bring about the effect of reliably separating the overlapping sheets sent out from a stack of sheets. This is because the sheet feeding roller and friction member should be essentially retained in a remarkably delicate contacting state so as to feed only one sheet skillfully and simultaneously avoid skidding of the sheet feeding roller (what is called "a non-feed phenomenon") which is caused by increasing the contact pressure of the friction member relative to the sheet to be fed, notwithstanding the intention of completely preventing the so-called double-feed phenomenon. Consequently, if the conditions such as coefficient of friction of the surface of the sheet to be fed and stiffness of the sheet do not conform to the design conditions of the sheet separation means including the friction member, or in a case that the overlapping sheets are in an unexpected state, the double-feed phenomenon would be inevitably brought about. In other words, since the conventional sheet separation means are designed in conformity with the properties (stiffness, coefficient of friction of the surface, thickness of the sheet, etc) of a specified sheet to be used, the aforementioned double-feed and non-feed phenomena are inevitably caused when using a sheet which is no match for the specified sheet. Such a disadvantage is due to the contacting condition of the sheet feeding roller and friction member, which condition is not changeable with the properties of the sheet to be fed.

Though the conventional sheet separation means as earlier given as the latter prior art employing the movable friction member which moves or rotates in the opposite direction to the rotation of the sheet feeding roller can relatively heighten the effect of separating the overlapping sheets, it is unsuitable for a thin sheet of paper and, over and above, becomes complicated in mechanism. If the conventional sheet separation means is so designed as to deal with the thin sheet of paper, it entails a problem such that a thick sheet of paper cannot be fed successfully. Some of the aforementioned prior art employ multi-stages of sheet separation means in order to remedy the drawbacks of the conventional sheet separation means as noted above, or otherwise, use a gate disposed at an access portion to the sheet separation means in order for allowing only a sheet having thickness smaller than a predetermined specific thickness to pass therethrough. However, there has not been hitherto proposed a sheet feeding device provided with a sheet separation means capable of dealing with any sheet of paper whatever and reliably separating the overlapping sheets so as to feed the stacked sheets one by one to a prescribed position.

In the sheet separation means in which the friction pad is in pressure contact with the sheet feeding roller as described in U.S. Pat. No. 4,368,880, the friction pad is swingingly supported by a retaining arm having its one end pivoted at a supporting point at a distance from the point of contact between the friction pad and the feeding roller, so that the friction pad moves away from the feeding roller about the supporting point when a sheet of paper enters between the pad and roller. Hence, since the friction pad leaves apart from the roller when the sheet of paper is fed, the space between the pad and roller is merely increased. As a result, this prior art has suffered a disadvantage that two or more sheets of paper easily intrude in therebetween and the so-called "double-feed" is susceptible to occur.

OBJECT OF THE INVENTION

This invention is made to eliminate the drawbacks suffered by the conventional sheet separation means as described above and has an object to provide a sheet feeding device having a sheet separation means capable of dealing with any sheet whatever and reliably separating the overlapping sheets, consequently to send out the sheets stacked on a sheet stacker one by one toward a prescribed position.

Another object of this invention is to provide a sheet feeding device having a sheet separation means capable of effectively feeding the stacked sheets one by one and being simple in structure, which device can readily be applied to copying machines, printers of various types, facsimile transmitters, or the like.

SUMMARY OF THE INVENTION

To attain the objects described above according to this invention there is provided a sheet feeding device comprising a sheet separation means having a sheet feeding roller and a friction pad which is in pressure contact with the sheet feeding roller in such a state that the friction pad is pivotable about a point of contact between the pad and roller so as to rotatably move backward relative to a sheet feeding direction i.e., such that a rearward portion of the friction pad moves closer to the feeding roller, when allowing a sheet to pass between the pad and roller with the rotation of the roller.

To pivot backward the friction pad when passing the sheet between the pad and roller, the friction pad may be provided at its front end with an uplift protrusion or slope toward the roller. When the sheet is fed along the friction pad by rotating the sheet feeding roller, the sheet passing through between the pad and roller acts on the uplift protrusion formed at the front end of the pad, to thereby move the uplift protrusion away from the sheet feeding roller. Consequently, the friction pad rotates backward (tilts on the upper stream side) about the point of contact between the pad and roller. Hence, the angle of entrance formed by the roller and pad can be large during non-feeding to thereby easily receive the sheet to be fed, and on the other hand, once the sheet is fed into between the pad and roller while acting on the uplift protrusion to allow the friction pad to tilt backward about the point of contact of the pad and roller, the angle of entrance for the sheet becomes small, consequently to prevent a successive sheet which may possibly intrude into between the rotating roller and pad from advancing without fail. Thus, the stacked sheets of any quality can be drawn out from the sheet stacker and sent out one by one without causing the double-feed phenomenon.

Additionally, by providing the sheet separation means with a restraining means, the effect of preventing the aforementioned double-feed phenomenon can be heightened.

The features of the present invention which are believed to be novel are set forth with particularity in the appended claims. The present invention, both as to its organization and manner or operation, together with further objects and advantages thereof, may best be understood by reference to the following description, taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The sheet feeding device according to this invention incorporates therein a sheet separation means for feeding copying or printing sheets of paper, documents or the like one by one, and is applicable to copying machines, printers of various types, facsimile transmitters and so on. As one example, the sheet feeding device applied to the copy machine will be described hereinafter with reference to the accompanying drawings.

Figure 1:
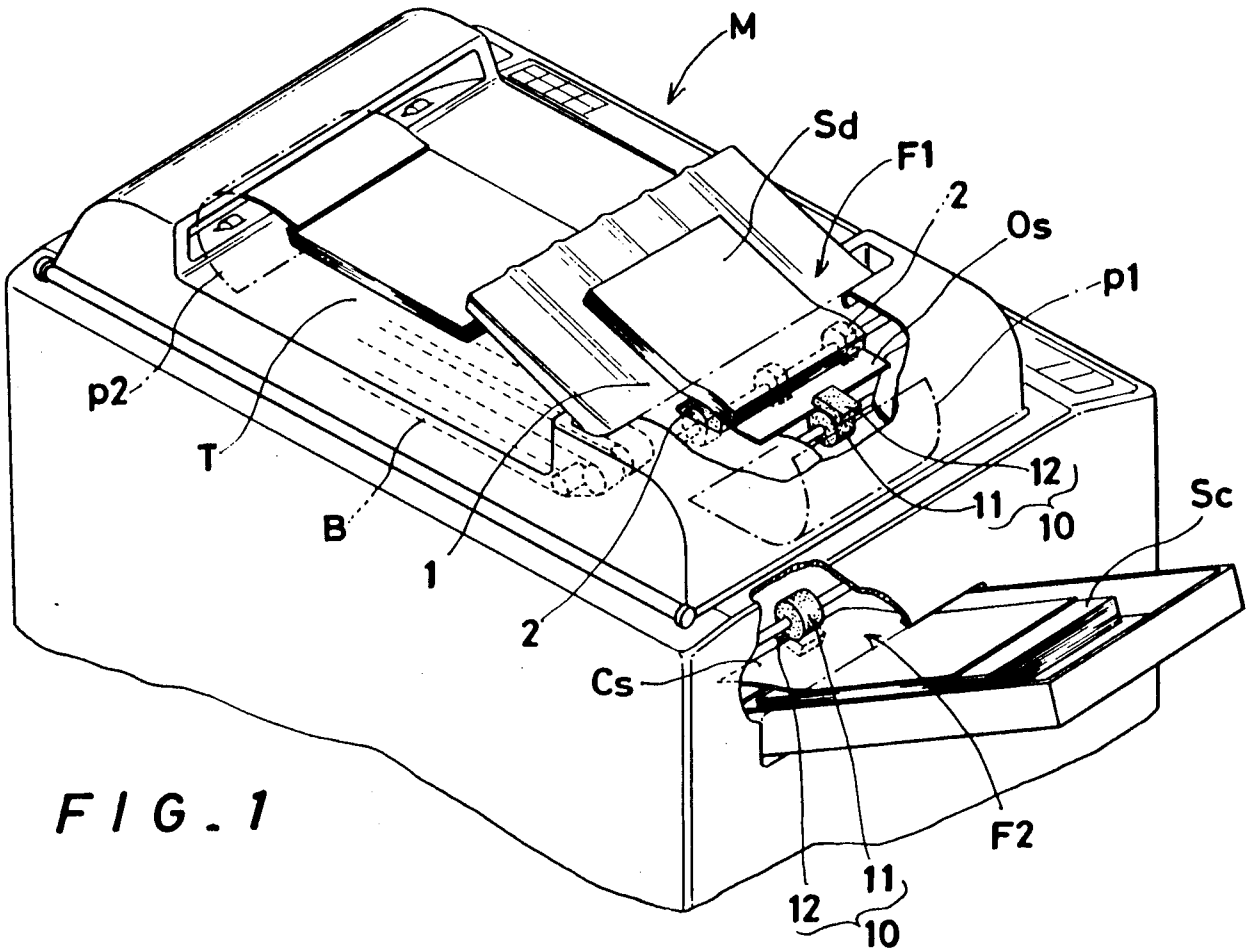
FIG. 1 is a fragmentarily broken away perspective view of a copying machine incorporating therein the sheet feeding devices according to the invention.

The copying machine M illustrated in FIG. 1 is provided with automatic sheet feeding devices F1, F2 of two types.

The sheet feeding device F1 is adapted for drawing out one document sheet Os from document sheets Sd stacked on a sheet stacker 1 and feeding the sheet Os to a prescribed copying portion on a copying platen, and the device F2 is for feeding a copying sheet of paper Cs from copying sheets Sc stacked in a piled state in a sheet cassette one by one to the inside the copying machine. The sheet feeding devices F1, F2 each have a sheet separation means 10 for reliably feeding out the stacked sheets Sd or Sc one by one.

In the illustrated copying machine M, the document sheet Os drawn out from the document sheets Sd stacked on the stacker 1 is fed into a passage p1 by the sheet feeding device F1 and sent to the copying portion on the copying platen by driving endless belts B. Upon carrying out a desired copying process, the document sheet Os is send out to a passage p2 by means of rotating endless belts B and discharged to an output tray T.

The document feeding operation noted above is repeatedly carried out until the document sheets on the sheet stacker 1 are out. In synchronism with the feeding of the document sheet, the signal sheet Cs is drawn out from the stacked copying sheets Sc one by one and fed into the copying machine M by operating the sheet feeding device F2. The mechanism and operation of the copying machine of this type are commonplace in the art and therefore will not be explained in detail.

The aforementioned sheet feeding devices F1 and F2 are substantially identical in structure with each other. Hence, the sheet device F1 for feeding the document sheets will be described herein.

Figure 2:
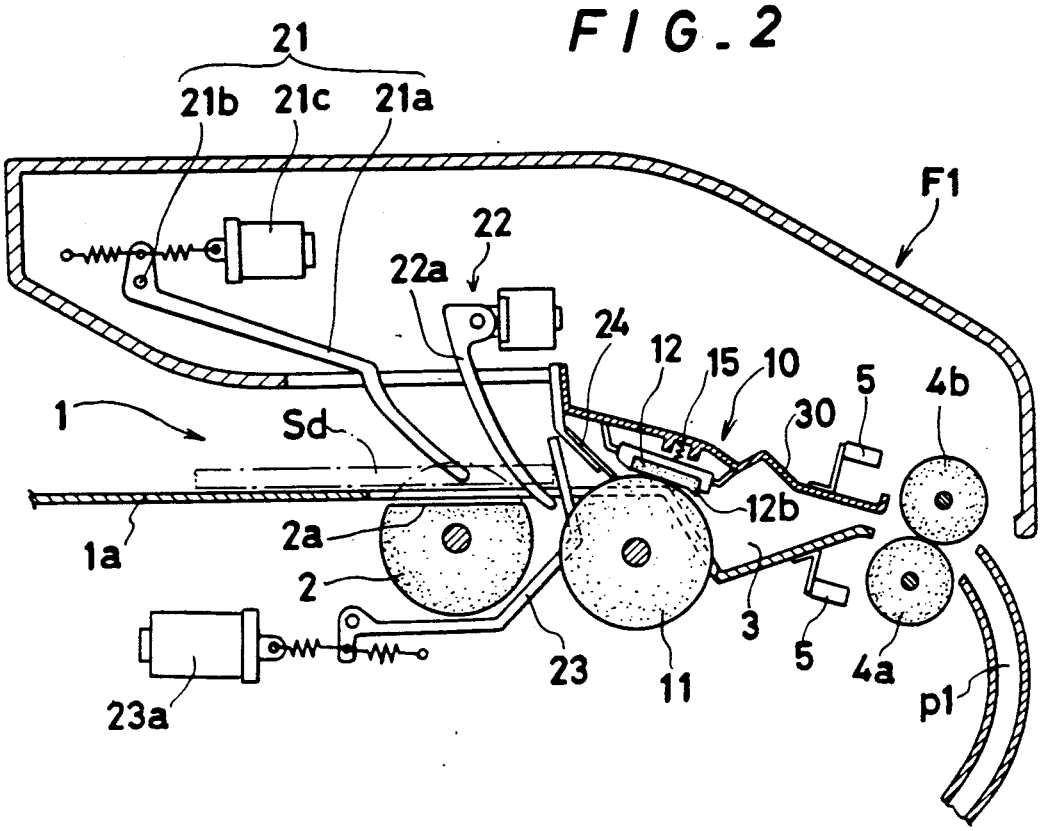
FIG. 2 is a sectional side view schematically showing one embodiment of the sheet feeding device of the invention.
Figure 4:
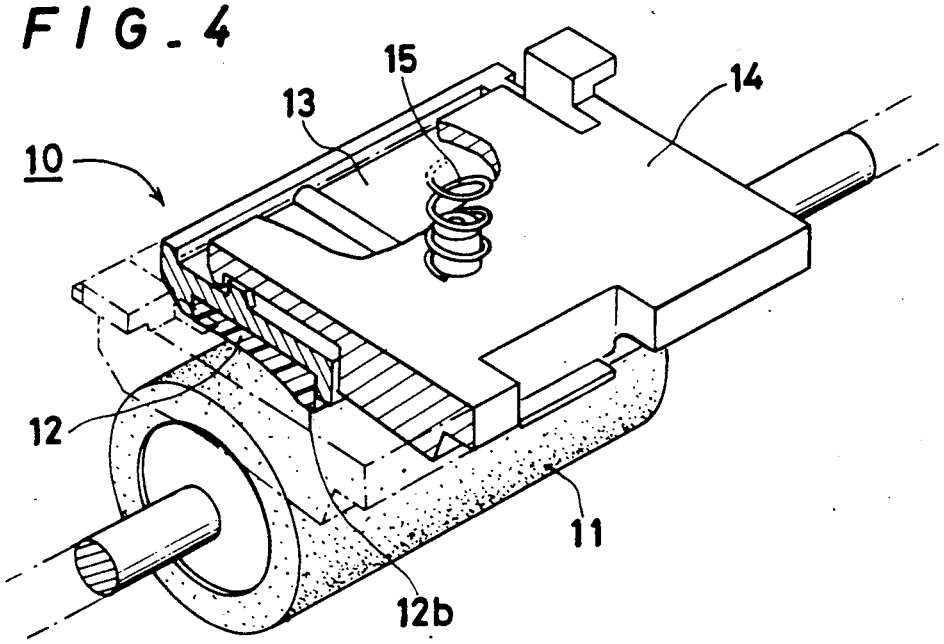
FIG. 4 is a partly broken away perspective view of the same sheet separation means.

The sheet feeding device F1 incorporates therein a sheet delivery system defining a sheet passage through which a sheet (sheet document) to be fed advances from the upper stream side (left side in FIG. 2) toward the down stream side (right side). The sheet delivery system comprises kick rollers 2 aligned widthwise, at least one sheet feeding roller 11 with which a friction pad 12 is in pressure contact to constitute a sheet separation means 10, and a pair of register rollers 4a, 4b which are distant from the sheet feeding roller 11 by a register space 3. The aforesaid passage p1 extends forward (in the down stream direction) from the register rollers 4a, 4b. There are disposed register sensors 5 one either side of the register space 3, so that the sheet feeding roller 11 being rotated to feed the sheet is stopped when a prescribed time lapses after the sensors 5 detects the leading end of the sheet being fed.

The kick roller 2 located at the first stage the sheet delivery system assumes a shape formed by cutting out a part of the circumferential portion of a cylinder with its secant. That is, the kick roller 2 is shaped in a substantial cylinder having a flat surface 2a. The kick roller 2 is so disposed as to level the flat surface 2a substantially with a bottom guide plate 1a of the sheet stacker 1 in a non-feeding state. Thus, when the kick roller 2 rotates clockwise in FIG. 2 in accordance with a feeding instruction given by a control system in the copying machine, the circumferential surface of the rotating kick roller 2 comes in frictional contact with the lowermost sheet of the stacked sheets Sd to thereby send out the lowermost sheet forwardly (rightward in the drawing). It goes without saying, of course, that the flat surface 2a is not necessarily required for the kick roller 2.

Additionally, at the first stage of the aforesaid sheet delivery system, there are disposed in position a sheet pressure means 21, an empty sensor 22, and a gate stopper 23, which are operated synchronously with the control system for presiding over the entire operations of the copying machine.

The sheet pressure means 21 comprises a pressure lever 21a having one end pivoted by an axial rod 21b and its free end close to the kick roller 2 and a solenoid 21c for urging downward the pressure lever 21a to exert a pressure force to the sheets stacked on the stacker 1 when the sheet is fed out. Thus, the stacked sheets on the stacker 1 is urged toward the kick roller 2 by the pressure lever 21a at an adequate pressure, so that the stacked sheets can be sent out without fail irrespective of the amount of the sheets.

The empty sensor 22 is provided with a contact lever 22a having its free end close to the kick roller 2 and serves to detect the presence of the sheet on the stacker 1. On the front end portion of the sheet stacker 1, there is disposed in position the gate stopper 23 movable upward and downward so as to intercept the sheet delivery passage defined on the guide plate 1a on non-feed. When the gate stopper projects upward from the guide plate 1a on non-feed, the leading edges of the sheets to be loaded on the sheet stacker 1 by hand can be trued up. When the sheet feeding device assumes the sheet feeding state, a solenoid 23a is operated to retract the gate stopper 23 below the guide plate 1a.

The sheet separation means 10 which is the principal constituent of the invention is located next to (on the lower stream side of) the kick roller 2 to fulfill the function of permitting only one sheet to pass therethrough even when two or more sheets are sent out from the sheet stacker 1.

As mentioned previously, the sheet separation means 10 comprises the sheet feeding roller 11 rotatable in one direction and the friction pad 12 being in frictional contact with the circumferential surface of the sheet feeding roller 11. Both the roller 11 and friction pad 12 may be made of any material having sufficient frictional coefficient and adequate elasticity and stiffness, such as rubber and urethane rubber.

When the sheet to be fed enters between the rotating roller 11 and the friction pad 12, it is sent out by the rotation of the roller 11. Meanwhile, when two sheets intrude in the overlapping state into between the roller 11 and pad 12, the sheet being in contact with the rotating roller 11 is sent out forward, but one being in contact with the pad 11 is stopped by the action of the frictional force brought about by the friction pad 12. Hence, the so-called "double-feed" phenomenon is prevented as will be described later in detail.

Figure 3A:
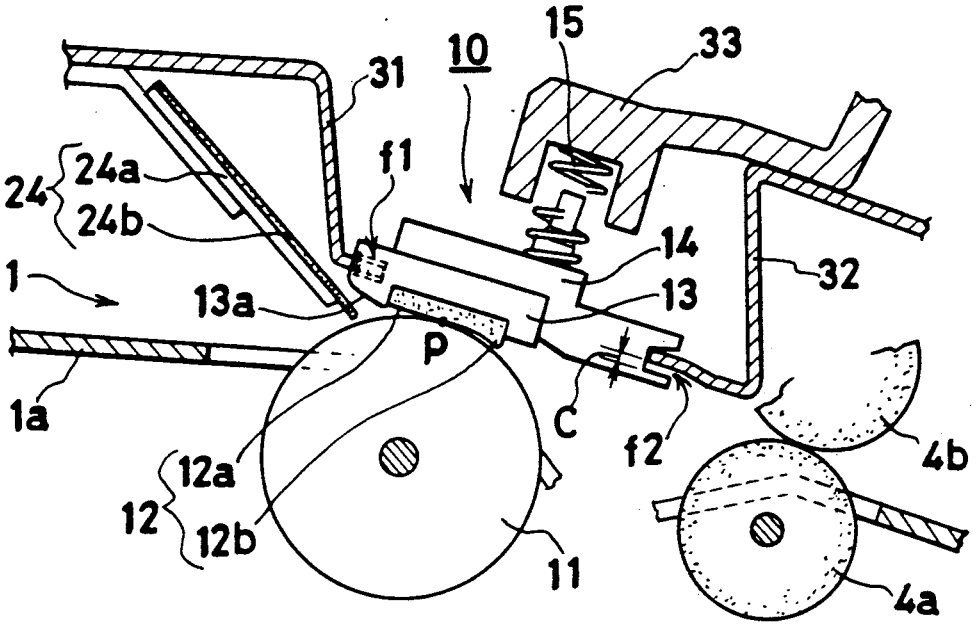
FIGS. 3A and 3B are sectional side view and plan view of the sheet separation means incorporated in the device shown in FIG. 2.
Figure 3B:
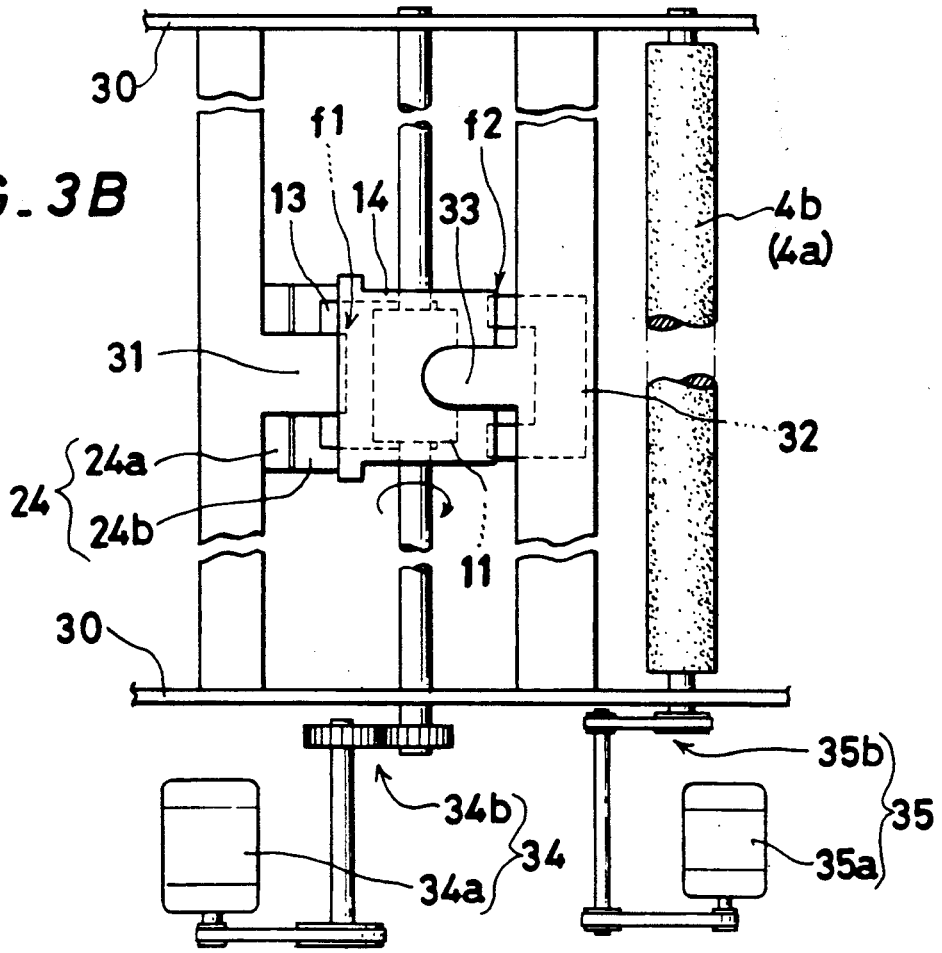

The sheet feeding roller 11 and friction pad 12 are in touch with each other at the point P when viewed from the side as illustrated in FIG. 3A. The contact point P is positioned approximately at the center of the friction pad 12 and means a "nip point" at which the sheet to be fed is first held between the roller 11 and the friction pad 12. The friction pad 12 has a contact surface 12a which comes in contact with the roller 11 in parallel to the tangent line passing through the contact point P of the roller 11, and an uplift protrusion or slope 12b formed on the front half portion of the pad and projecting toward the roller 11. This friction pad 12 is supported rockingly backward (leftward in FIG. 3A) substantially about the contact point P.

In this embodiment, the friction pad 12 is held by a pad holder 13 and a movable supporting member 14 for supporting the pad 12 and pad holder 13. The pad holder 13 is movably supported at a supporting point f1 of the rear end thereof by a supporting plate 31 extending from a body frame 30, and likewise, the movable supporting member 14 is movably supported at a supporting point f2 of the front end thereof by a supporting plate 32 extending from the body frame 30. This supporting mechanism serves to permit the friction pad 12 to pivot substantially around the contact point P as a fulcrum. In order to allow the friction pad 12 to pivot about the contact point P, at least the supporting point f2 may be provided with a clearance c. The rocking movement of the pad 12 about the contact point P is caused by advancing the sheet along the contact surface 12a of the pad 12 to urge upward the uplift protrusion 12b formed on the front half portion of the pad 12.

The pad holder 13 may preferably be provided at its rear and lower portion with a sheet receiving surface 13a so as to enlarge the entrance for the sheet to be fed.

As an urging means for pressing the friction pad 12 onto the feeding roller 11, there is used a spring 15 which is held by a retainer member 33 fixed on the frame 30. It is desirable to urge the friction pad 12 against the roller 11 at a certain point of the front half portion of the pad 12. Namely, the spring 15 may preferably be located on the right side relative to the center of the pad 12 in FIG. 3A.

In the illustrated sheet feeding device, there is disposed a sheet restraining means 24 at the entrance of the sheet separation means 10 to improve the effect of preventing the double-feed phenomenon.

The sheet restraining means 24 comprises a first restraining member 24*a* formed of a plate having relatively large rigidity such as metal or plastic material, and a second restraining member 24*b* made of elastic material such as rubber. The united first and second restraining members are arranged so as to make an acute angle with the guide plate 1*a*. The free end (lower end in the illustrated embodiment) of the first restraining member 24*a* is somewhat separated from the sheet feeding roller 11, and that of the second restraining member 24*b* is close to or slightly contacted with the sheet feeding roller 11.

The rigid first restraining member 24*a* of the sheet restraining means 24 eliminates a disadvantage of causing large amounts of the sheets stacked on the sheet stacker 1 to simultaneously intrude between the sheet feeding roller 11 and the friction pad 12. Furthermore, with the elastic second restraining member 24*b*, lots sheets eventually passing simultaneously through the first restraining member 24*a* are restricted so as to allow a single sheet to pass therethrough. If by any chance two or more sheets pass through the sheet restraining means 24 in the overlapping state, the overlapping sheets can be completely separated by the sheet separation means 10 of the invention to thereby send out only one sheet toward the prescribed sheet delivery passage p1.

In the drawings, reference numeral 34 denotes a driving system for the sheet feeding roller 11, which comprises a motor 34*a* and transmission means 34*b*. By 35 is denoted a driving system for rotating at least one of the register rollers 4*a*, 4*b*, which comprises a motor 35*a* and transmission means 35*b*.

Next, the operation of the sheet separation means mentioned above will be described with reference to FIGS. 5A to 5C and FIG. 6.

Figure 5A:
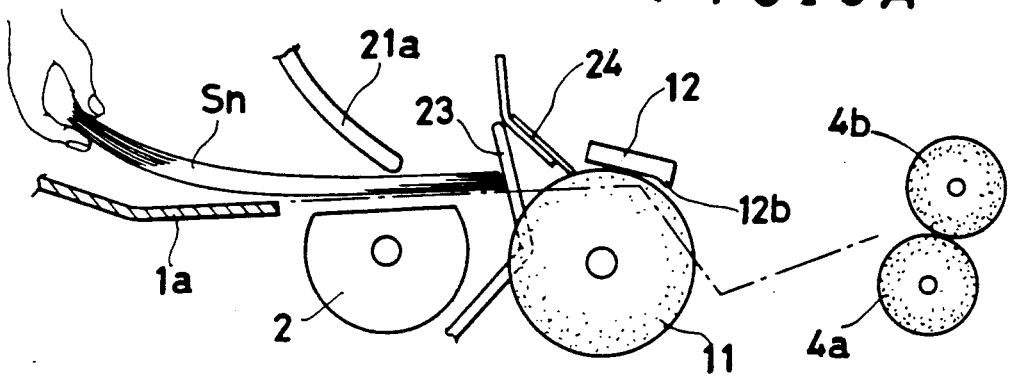
FIGS. 5A through 5C are sectional side views in explanation of the operation of the sheet separation means in a normal feeding state.

At the outset, a plurality of sheets are loaded on the sheet stacker 1 by hand so as to turn up the leading edge of the stack of sheets Sn by the gate stopper 23 which protrudes upward from the guide plate 1*a* on non-feed, as shown in FIG. 5A.

Once an instruction to feed the sheets is received, the gate stopper 23 is evacuated downward, and simultaneously, the kick roller 2 starts rotating. At this time, the pressure lever 21*b* comes in pressure contact with the stacked sheets Sn to urge the stacked sheets against the kick roller 2 at an adequate pressure.

Figure 5B:
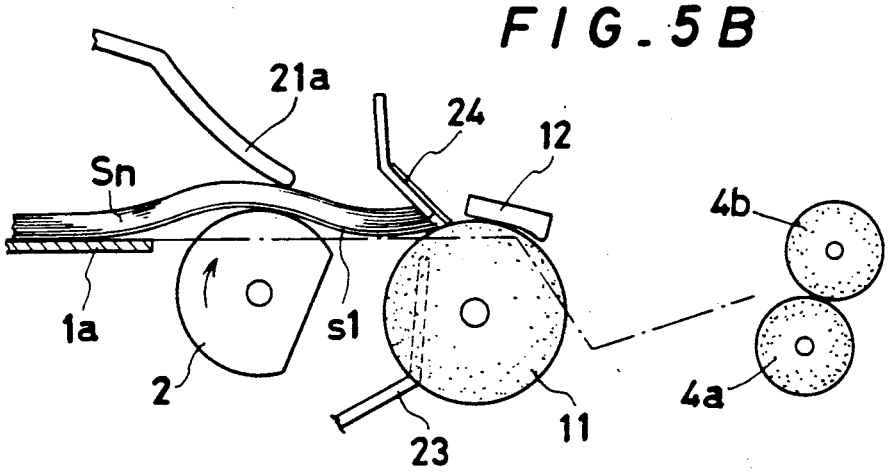

With the rotation of the kick roller 2, at least the lowermost sheet which is in direct contact with the kick roller 2 is sent out. In FIG. 5B is illustrated the state in that the stacked sheets Sn all move to the sheet restriction means 24 with the rotation of the kick roller 2. At the time, the lowermost sheet s1 of the stacked sheets Sn comes in contact with the sheet feeding roller 11 which starts rotating simultaneously with the kick roller 2. Though the rotating kick roller 2 imparts an advancing force to the stacked sheets Sn, the stacked sheets are obstructed by sheet restraining means 24. The stacked sheets Sn in large part are checked by the rigid first restraining member 24*a*, so that the pressure of the stacked sheets exerted to the second restraining member 24*b* can remarkably be reduced.

Figure 5C:
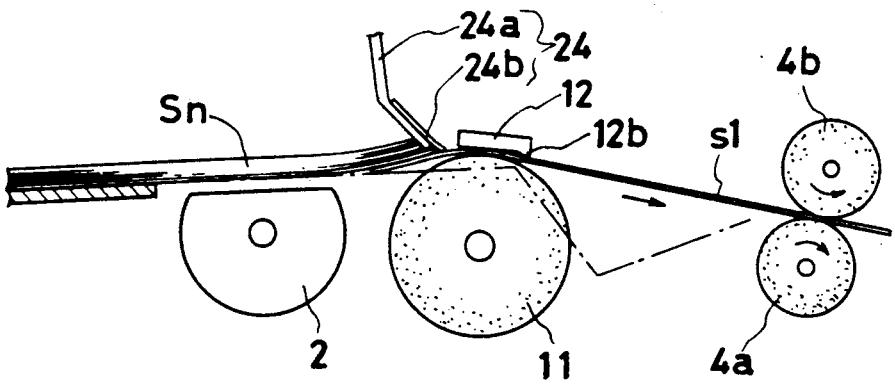

The lowermost sheet s1 being in direct contact with the rotating kick roller 2 and sheet feeding roller 11 moves forward through the elastic second restraining member 24*b*. The second sheet subsequent to the lowermost sheet s1 is obstructed by the frictional force of the elastic second restraining member 24*b*. Then, the lowermost sheet s1 reaches the rotating register roller 4*a*, 4*b* and is pulled by the rollers 4*a*, 4*b* to be sent out forward, as illustrated in FIG. 5C (normal feeding state).

Figure 6A:
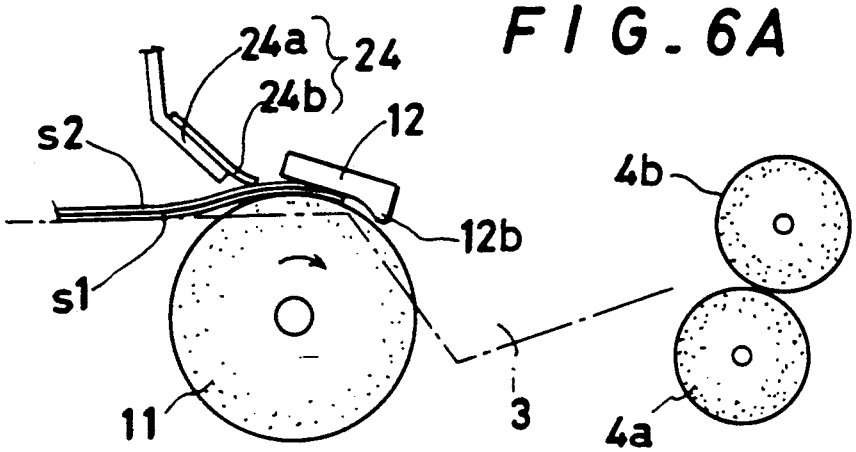
FIGS. 6A and 6B are schematic side views for explaining the principle of fulfilling the sheet separating function of the sheet separation means of the invention.
Figure 6B:
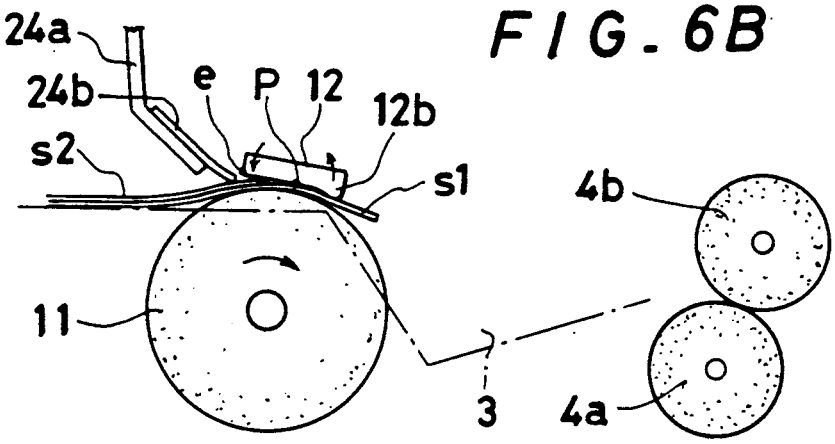

However, there is a case that the subsequent sheet is in close contact with the lowermost sheet s1 to be fed firstly. In this case, two sheets may possibly pass through the sheet restraining means 24 in the overlapping state to intrude into between the rotating sheet feeding roller 11 and the friction pad 12 as illustrated in FIG. 6A. The lowermost sheet s1 is forcibly fed by the action of the rotating sheet feeding roller 11, but the upper sheet s2 is obstructed by the frictional force of the friction pad 12. Hence, the "double-feed" can be prevented.

Still, it may happen that the overlapping sheets s1, s2 cannot be separated even by the frictional force of the friction pad 12, consequently to advance together between the feeding roller 11 and the pad 12. However, when at least the lowermost sheet s1 reaches and begins touching the uplift protrusion 12*b*, the friction pad 12 is rockingly moved backward (counterclockwise in FIG. 6B) around the contact point P due to the thickness and stiffness of the sheet s1. As a result, the rear end e of the pad 12 is pressed downward and toward the feed roller against the overlapping sheets s1, s2 with the backward rocking movement of the pad 12 to thereby increase the frictional pressure against the upper sheet s2 so as to obstruct the sheet s2. Thus, the "double-feed" can be completely prevented.

Then, only the lowermost sheet s1 is fed to the rotating register rollers 4*a*, 4*b* through the register space 3 and sent out into the feeding passage p1. When the sheet s1 is released from the roller 11 and pad 12, the friction pad 12 returns to its original state. Consequently, the subsequent sheet s2 is freed from the rear end e of the pad 12, but can no longer advance because the kick roller 2 and the sheet feeding roller 11 are stopped at the time when the preceding sheet s1 is seized by the rotating register rollers 4*a*, 4*b*. The sheet s2 remained between the roller 11 and pad 12 is first of all fed when commencing the subsequent sheet feeding processing.

Figure 7:
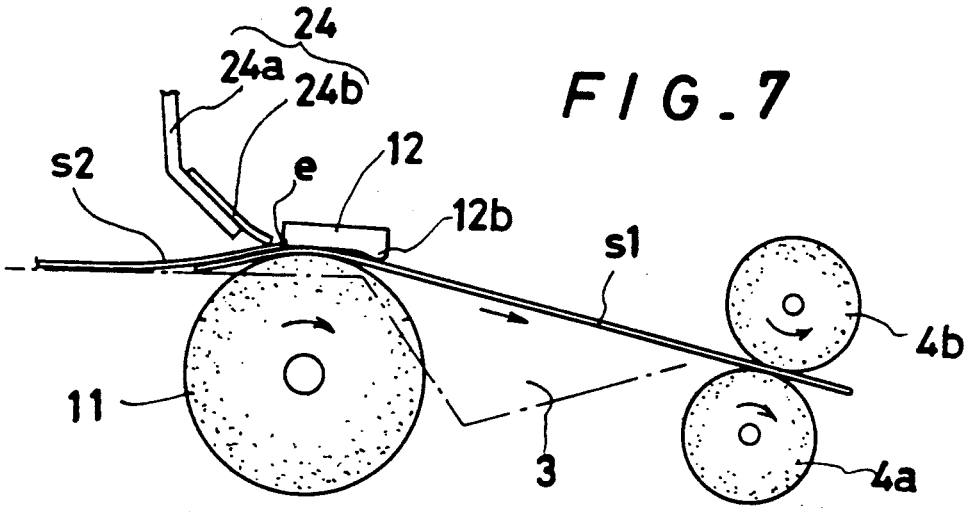
FIG. 7 is a schematic side view for explaining the principle of the function of preventing the double-feed phenomenon.

In the meantime, in a case that the subsequent sheet s2 is released from the second restraining member 24*b* and advances toward the sheet separation means 10 in the midst of feeding the first sheet s1 through between the rotating roller 11 and pad 12, the sheet s2 can no longer intrude into between the roller 11 and pad 12. This is because the friction pad 12 is already tilted backward by the sheet s1 which passes through the sheet separation means 10 while forcing up the uplift protrusion 12*b* with the result that the leading end of the sheet s2 collides with the rear end e of the pad 12 as illustrated in FIG. 7.

As stated above, even if the remarkable situation resulting in the double-feed phenomenon is brought about, only one sheet can be reliably sent out from a stack of sheets by the action of the friction pad 12 movable rockingly backward like a seesaw.

Incidentally, the aforementioned kick roller 2, sheet pressure means 21, empty sensor 22, gate stopper 23 and register rollers 4*a*, 4*b* which constitute the sheet delivery system are not necessarily indispensable to this invention, and therefore, should not be understood as limitative.

It is preferable to provide the sheet separation means having the following structural conditions for fulfilling the function of reliably separating the overlapping sheets.

Figure 8:
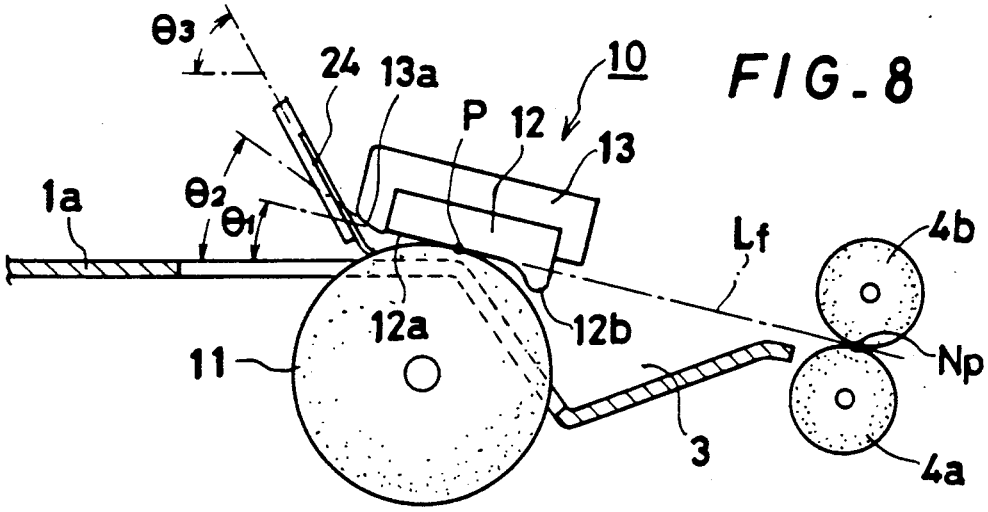
FIG. 8 is a schematic view for explaining structural conditions of the sheet separation means.

The friction pad 12 is disposed tilting forward (in the sheet feeding direction) in the original state (non-feed state) while coming in contact with the sheet feeding roller 11 substantially at the center (pointP) of the pad 12 as illustrated in FIG. 8. Namely, the contact surface 12*a* of the pad 12 is in parallel with the tangent line which touches the circumferential surface of the roller 11 at the point P. The friction pad 12 preferably assumes such a state that the extension line Lf from the aforesaid contact surface 12*a* passes substantially through aforesaid the contact point Np of the register rollers 4*a*, 4*b*.

The inclination of the friction pad 12 may be preferably determined so that a sheet receiving angle $\theta 1$ of the contact surface 12*a* with the guide plate 1*a* (equivalent to the sheet feeding direction) on non-feed is 9° to 16°. And preferably, the sheet receiving surface 13*a* on the lower rear end of the pad holder 13 makes an angle $\theta_2$ of 15° to 22° with the guide plate 1*a*.

Furthermore, it has been found that the aforementioned effect of the sheet restraining means 24 can be heightened by being inclined at an angle $\theta_3$ of 50° to 57° with the guide plate 1*a*. Since the aforesaid angular conditions of the pad 12 and sheet restraining means 24 should be determined in accordance with the property of the sheet to be fed, the structures of peripheral mechanisms and other factors, this invention does not limit the angular conditions in these components. In order to maintain the friction pad 12 in the aforenoted state on non-feed, the spring 15 serving as the urging means for the pad 12 may preferably be positioned on the front half portion ahead of the contact point P of the pad 12. What determines the aforesaid structural conditions of the pad 12 is a supporting structure including the engaged pad holder 13 and supporting plate 31 and the engaged movable supporting member 14 and supporting plate 32 as touched upon above, nevertheless the supporting structure for the friction pad 12 is not specifically limited and can be of course modified in various ways.

Figure 9:
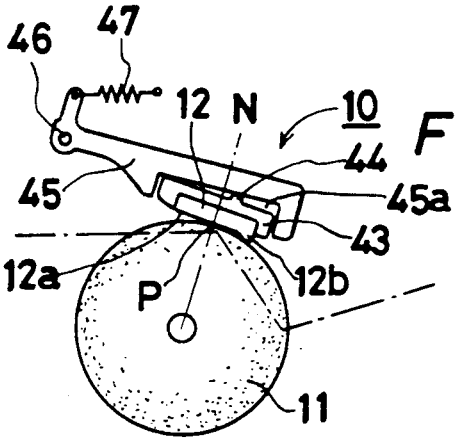
FIG. 9 is a schematic side view showing another embodiment of the sheet separation means of the invention.

A modified example of the supporting structure for effecting the desired rocking movement of the friction pad 12 is illustrated in FIG. 9.

In this second embodiment, the friction pad 12 retained by a pad holder 43 is loosely held within a pad cavity 45*a* formed in a pad supporting member 45 which is pivotally fixed by an axial shaft 46. The pad holder 43 is provided on its upper surface opposite to the innermost wall of the pad cavity 45*a* with a convex fulcrum 44. The convex fulcrum 44 is formed on the forward side (closer to the uplift protrusion 12*b*) relative to the normal line N on the contact point P (line perpendicular from the point P on the tangent line) of the sheet feeding roller 11. The pad supporting member 45 is urged by an urging means such as a spring 47 toward the sheet feeding roller 11.

According to this embodiment, when feeding a sheet, the friction pad 12 is rockingly moved backward (counterclockwise in the drawing) while shifting the convex fulcrum 44 toward the normal line N, because the sheet passing through the sheet separation means 10 forces up the uplift protrusion 12*b*. As a result, a second sheet to be successfully fed is completely prevented from intruding into or passing through between the roller 11 and pad 12. After the first sheet being fed is released from the sheet separation means 10, the friction pad 12 returns to its original state illustrated in FIG. 9 with the convex fulcrum 44 being urged forward (in the direction away from the normal line N) by the supporting member 45. Thus, the double-feed phenomenon can be successfully prevented.

Figure 10:
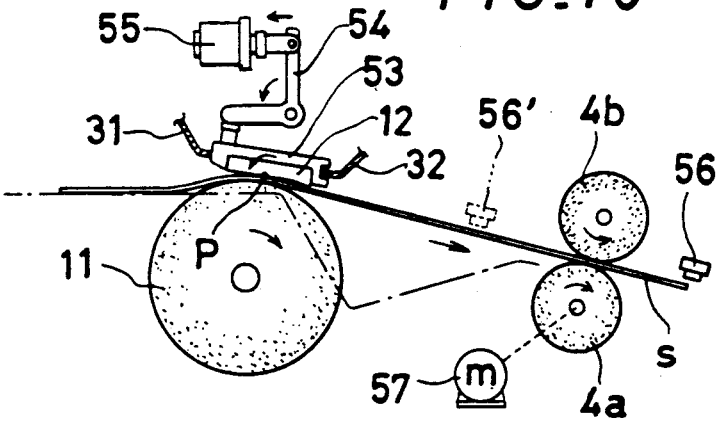
FIG. 10 is a schematic side view showing still another embodiment of the sheet separation means of the invention.

In FIG. 10 is shown the third embodiment of the sheet separation means, in which the friction pad 12 is rockingly moved electrically. A pad holder 53 retaining the friction pad 12 is supported movably backward by the support plates 31, 32 extending from the body frame similarly to the first embodiment as described earlier. The friction pad 12 rockingly moves backward about the contact point P by actuating a solenoid 55 to urge downward the rear end of the friction pad 12 through the medium of a lever 54. The solenoid 55 is actuated at the time when the sheet s being fed is detected by a sheet sensor 56 beyond the register rollers 4*a*, 4*b* or simultaneously with actuating a motor (m) 57 for driving the register roller 4*a*. That is to say, upon confirming the fact that the sheet passes through the sheet separation means 10, the friction pad 12 is rocked backward to thereby prevent the double-feed phenomenon. According to this embodiment, the effect of preventing the double-feed can be heightened because the friction pad 12 can be forcibly rocked backward.

The structure in which the operation of the solenoid 55 is trigged by the sheet sensor 56 or synchronously with actuating the motor 57 should not be limited to that illustrated in the drawing. For example, the sheet sensor 56 may be at the position 56' behind the register rollers 4*a*, 4*b*.

Figure 11:
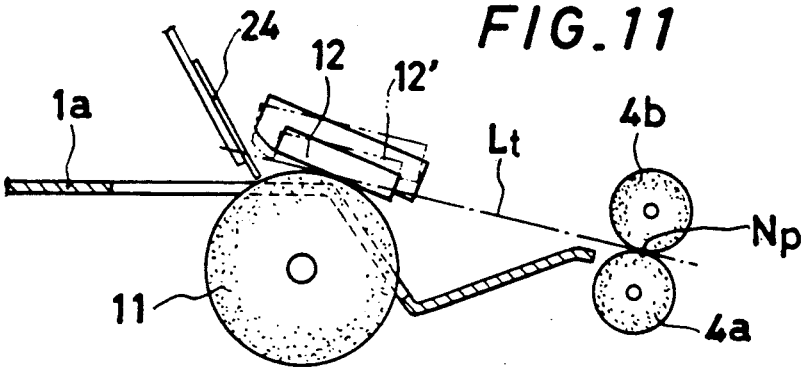
FIG. 11 is a schematic side view showing a further embodiment of the sheet separation means of the invention.

Though, in the case where the friction pad 12 has the uplift protrusion 12*b* as in the foregoing embodiments, the pad 12 assumes its original state such that the extension line Lf from the contact surface 12*a* of the pad 12 passes substantially through the nip point Np of the register rollers 4*a*, 4*b*, the friction pad 12 however need not necessarily be provided with such an uplift protrusion as illustrated in FIG. 11. To be more specific, in the case of using the function pad 12 having a substantially flat contact surface, the same effect as those brought about by the foregoing embodiments can be attained by inclining the friction pad 12 at a larger angle than that of the tangent line Lt of the feeding roller 11 which passes through the nip point Np of the register rollers 4*a*, 4*b* on non-feed. That is, the front end of the contact surface of the pad 12 is positioned below the aforesaid tangent line Lt. With the structure noted above, the friction pad 12 can be rocked backward as illustrated by the chain line in FIG. 11 when the sheet passing through between the roller 11 and pad 12 reaches the nip point Np of the register rollers 4*a*, 4*b* and is pulled by the rotating register rollers, resulting in giving tension to the sheet. Consequently, the double-feed can be presented similarly to the foregoing embodiments.

In contrast with the sheet feeding devices described above in which the lowermost sheet is sent out from a stack of sheets, there may be so constructed that the uppermost sheet is sent out from the stacked sheets as in the sheet feeding device F2 illustrated in FIG. 1. Also, the positional relation between the roller 11 and the pad 12 may of course be inverted as in the sheet feeding device F2 of FIG. 1. In addition, two or more sheet separation means 10 may be applied to one sheet feeding device in accordance with various conditions such as the width of the sheet to be fed.

As is clear from the description given above, since the sheet feeding device according to the invention comprises a sheet separation means having a sheet feeding roller and a friction pad which is rockingly moved backward by the action of a sheet passing therethrough to thereby prevent simultaneous feeding of overlapping sheets, which is called "a double-feed phenomenon". Consequently, the sheets stacked on a sheet stacker in a copying machine, a printer or the like can be reliably sent out one by one to a prescribed position in the copying machine and so on without causing the double-feed phenomenon. Because the double-feed phenomenon can be successfully prevented by the rocking movement of the friction pad, a pressure force of the pad against the sheet to be fed can be made relatively small, and therefore, the sheet can be reliably fed between the sheet feeding roller and the pad without incurring stress and be effectively sent out without causing the double-feed in spite of the thickness and surface condition of the sheets to be fed.

Besides, since the rocking movement of the friction pad can be performed by means of a simple supporting structure, the sheet separation means of the invention is easily applicable to any sheet feeding device incorporated in various systems including a copying machine and a printer. In addition, since the sheet feeding device of the invention is provided with a sheet restraining means composed of a rigid first restraining member having moderate stiffness and an elastic second restraining member, the effect of preventing the double-feed can be remarkably heightened.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A sheet feeding device for feeding stacked sheets one by one, comprising at least one sheet separation means including:

a driven sheet feeding roller rotatable to feed a sheet in a forward direction;

a friction pad positioned so as to contact said feeding roller at a contact point when no sheet is being fed therebetween, said friction pad including a substantially flat contact surface including said contact point, said contact surface including an uplift protrusion at a portion thereof forward of said contact point; and means for mounting said friction pad such that said friction pad can pivot about a fulcrum substantially corresponding to said contact point, whereby passage of a sheet past said uplift protrusion causes said friction pad to pivot about the fulcrum so that a portion of the contact surface rearward of the contact surface rearward of the contact point moves closer to the feeding roller.

2. A sheet feeding device according to claim 1, including a pad holder which is movably supported at front and rear supporting points thereof by means of supporting plates, said pad holder supporting said friction pad, the front supporting point being provided with a clearance, and urging means for urging said friction pad toward the sheet feeding roller.

3. A sheet feeding device according to claim 1, including a pad holder to which a movable supporting member is attached, said pad holder holding said friction pad and being supported at a rear supporting point thereof by a supporting plate and said movable supporting member being supported at a front supporting point thereof with a clearance by another supporting plate, and urging means for urging said friction pad toward the sheet feeding roller.

4. A sheet feeding device according to claim 1, including a pad holder having a convex fulcrum, said pad holder being loosely held within a pad cavity formed in a pad supporting member, whereby the friction pad is rockingly moved backward by a sheet passing between said sheet feeding roller and said friction pad.

5. A sheet feeding device according to claim 1 further comprising a sheet restraining means composed of a first restraining member having stiffness and a second restraining member having elasticity, said first restraining member having a free end somewhat separated from said sheet feeding roller, and said second restraining member having a free end close to or slightly contacted with said sheet feeding roller.

6. A sheet feeding device according to claim 1 including a pair of register rollers spaced from said sheet feeding roller by a register space.

7. A sheet feeding device according to claim 6, wherein said friction pad is inclined at a larger angle than that of a tangent line of the feeding roller, which line passes through a contact point of said register rollers on non-feed.

8. A sheet feeding device according to claim 6, further comprising a sheet delivery system including a sheet stacker for stacking the sheets, a kick roller incorporated in said sheet stacker for sending out the sheet from the stacked sheets, a sheet pressure means for exerting a pressure force to the stacked sheets, and a gate stopper retractably disposed so as to true up the stacked sheets on non-feed.

9. A sheet feeding device according to claim 6, wherein said friction pad is rockingly moved electrically when the sheet is fed through said sheet separation means.

10. A sheet feeding device according to claim 6 wherein said contact surface of the friction pad is inclined so as to have its extension line substantially passing through a contact point of said register rollers.

* * * * *